United States Patent [19]

Cerutti et al.

[11] 4,407,609

[45] Oct. 4, 1983

[54] APPARATUS AND METHOD FOR PROVIDING NEGATIVE BUOYANCY FOR TUNNEL FORMS

[75] Inventors: Henry P. Cerutti, Seminole; Robert A. Cannon; George G. Lindbloom, both of Allison Park, all of Pa.

[73] Assignee: White Consolidated Industries, Inc., Cleveland, Ohio

[21] Appl. No.: 208,625

[22] Filed: Nov. 20, 1980

[51] Int. Cl.[3] ..... E21D 9/06

[52] U.S. Cl. ..... 405/146; 249/11; 405/132; 405/150; 425/59; 425/64

[58] Field of Search ..... 405/146, 138, 136, 137, 405/141, 150; 425/59-64; 249/11; 264/32, 33

[56] References Cited

U.S. PATENT DOCUMENTS

| | | | |
|---|---|---|---|
| 1,751,147 | 3/1930 | Hackley | 405/146 |
| 2,264,054 | 11/1941 | Sarosdy | 264/32 |
| 2,870,518 | 1/1959 | Bossner | 425/59 X |
| 2,995,901 | 8/1961 | Kemper | 405/146 X |
| 3,206,824 | 9/1965 | Cerutti | 405/138 X |
| 3,922,124 | 11/1975 | Bjorhaag | 425/64 |

FOREIGN PATENT DOCUMENTS

| | | | |
|---|---|---|---|
| 2920601 | 11/1979 | Fed. Rep. of Germany | 405/291 |

*Primary Examiner*—Dennis L. Taylor

*Attorney, Agent, or Firm*—Buell, Blenko, Ziesenheim & Beck

[57] ABSTRACT

A method and apparatus for eliminating the necessity of providing hold-down devices, such as spuds and anchors, for opposing buoyancy in tunnel forms. The method comprises providing a movable counterweight car which preceeds the flow of fluid concretes, as it slopes from the crown of the tunnel forms downward and thus provides negative buoyancy at that area where there is the most fluid concrete and in that area where the most uplift occurs as well as the natural area where there are no forces of the crown helping to prevent flotation. The movable counterweight car is a hollow container curved to match the curvature of the excavated tunnel and clearing the movement of the forms. It has wheels that run on single track rails carried on the inside of the tunnel forms, the container being wholly or partly filled with steel scrap or punchings. The counterweight car has a fixed distance relationship to the discharge point of the concrete pump which generally precedes the discharge point of the slick line over the crown. A light cable connects the counterweight car to the slick line carrier or pump carrier and causes movement of the counterweight car at the same rate of speed as the slick line is withdrawn, thus synchronizing the movement of the counterweight car to the concrete pumping operation.

14 Claims, 10 Drawing Figures

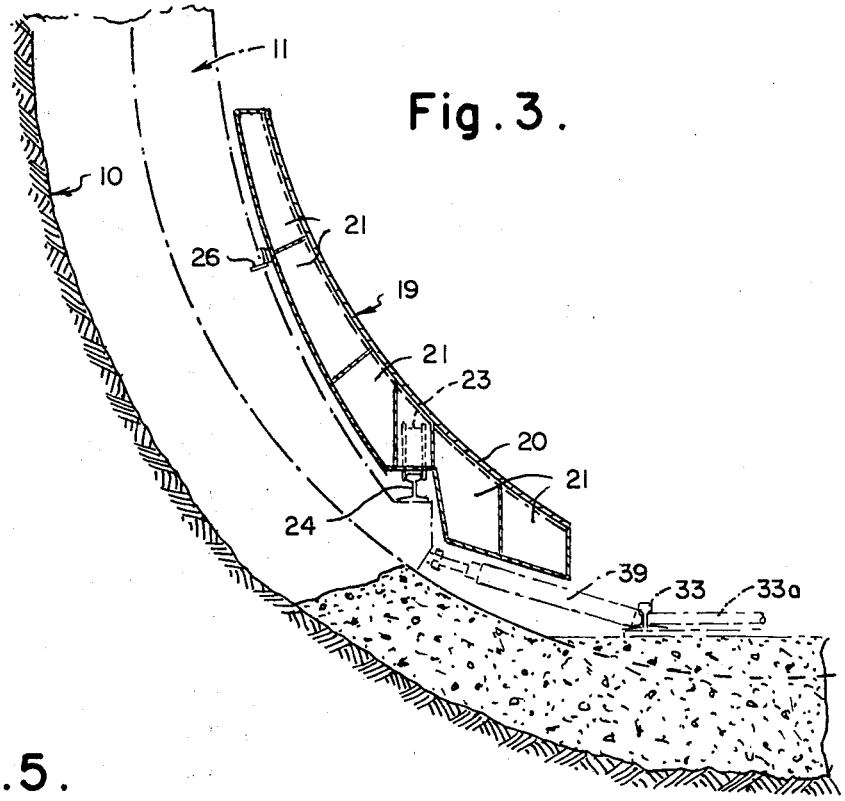
Fig. 3.
Fig. 5.
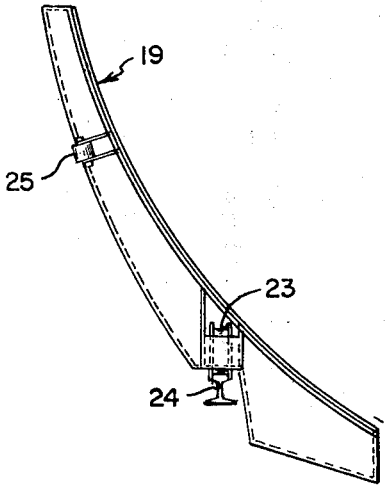
Fig. 4.
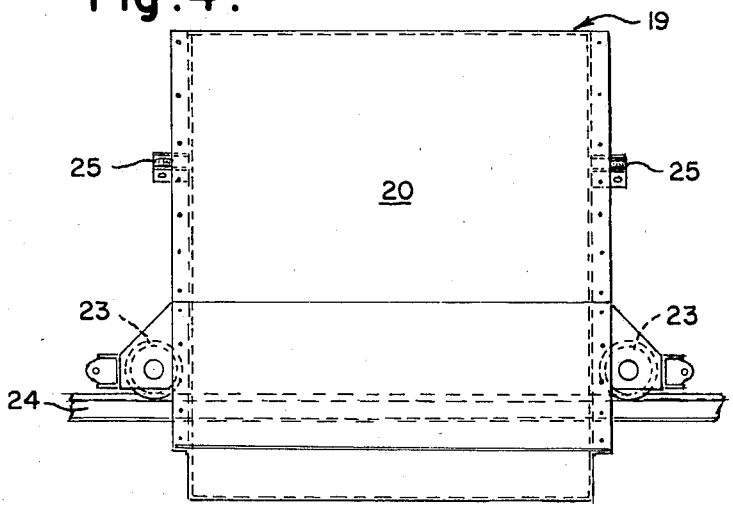
Fig. 6.
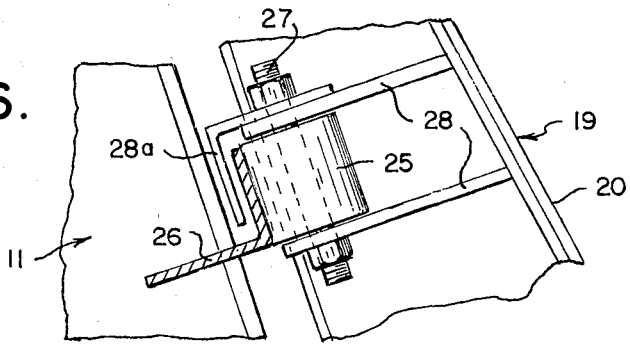

APPARATUS AND METHOD FOR PROVIDING NEGATIVE BUOYANCY FOR TUNNEL FORMS

This invention relates to a method and means for preventing flotation of the tunnel forms in an excavated tunnel due to their buoyancy in fluid concrete slurry as it slopes downwardly from the point at which the fluid concrete is supplied to the space between the tunnel bore and the crown of the arch forms from the slick line.

Various methods and means are currently resorted to for counteracting buoyancy in tunnel forms. The usual method is to use anchor bolts in the bottom concrete and a few spuds to the rock of the tunnel bore. Another method is to use so-called side-kickers at the bottom of the tunnel forms. This is simply using hydraulic rams to exert a lateral force on the bottom end of an invert tunnel form. The uplift contributed by the side-kickers must be counteracted by crown spuds or anchor bolts on very close centers.

The labor and time required to place the side-kickers, spuds, and anchor bolts is considerable and the present invention is intended to circumvent and avoid the labor and expense involved in heretofore known methods and means for counteracting buoyancy in tunnel forms.

This invention simply utilizes a movable body or counterweight in the form of a hollow compartmented container, adapted to receive scrap iron and the like and which is curved to conform to the tunnel bore and to provide clearance with the tunnel forms to enable them to be telescopically removed. The counterweight travels on flanged wheels which roll on a single rail attached to or fixed in the bottom portion of the arch forms and provides a counteracting force to buoyancy in the tunnel forms, that is provides negative buoyancy.

In order to provide maximum effectiveness of the counterweight, we synchronize the movement thereof with the concrete pumping operation. This is done by maintaining a fixed distance relationship from the movable counterweights to the discharge point of the pump supplying concrete slurry to the tunnel forms.

A prior known method for installing and removing tunnel forms is described in U.S. Pat. No. 2,264,054 of Louis J. Sarosdy, issued Nov. 25, 1941. It is to be noted, however, that the method described in the patent is much more timeconsuming and laborious than the method which we have devised.

The method and apparatus which we have devised is described hereinafter in detail in relation to the accompanying drawings, wherein:

FIG. 3 is a fragmentary sectional view showing the compartmented counterweight;

FIG. 4 is a side view of a counterweight car, showing the flanged wheels and rollers on which the counterweight cars roll;

FIG. 5 is an end view of a counterweight car shown in FIG. 4, as viewed from the left;

FIG. 6 is an enlarged fragmentary view of a roller for providing supplemental support to a counterweight car;

Figure 1:
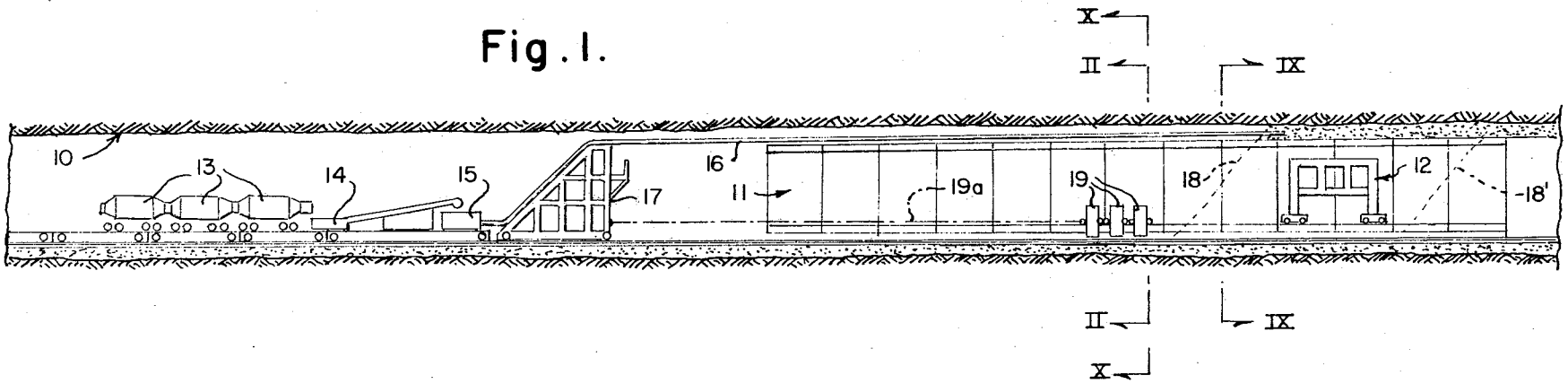
FIG. 1 depicts in general the disposition of tunnel forms in a rock bore for a casting operation and the relation of the apparatus which we provide for producing negative buoyancy.

Referring to FIG. 1 of the drawings, there is shown a tunnel bore 10 in which a series of arch forms 11 are installed. The arch forms are approximately 30 feet long and there may be as many as 13–15 arch forms units installed in side by side relation to provide for casting with concrete in a full day of operation. Thus, a large supply of concrete in slurry form is required to complete a single day of casting operation. For this purpose the concrete is brought into the tunnel bore in two trains of conveyor cars 13 pulled or pushed into the bore by locomotives on two parallel tracks. The concrete is deposited in a conveyor hopper 14 from the conveyor cars 13, and then delivered by the conveyor to a pump 15 which forces the concrete under pressure through a flexible hose or pipe 16, called a slick line. The slick line is carried by a car 17, called the rise car, and extends into the space between the crown of the arch forms and the bore 10, into which space the concrete is emitted. The slope of the concrete emitted into the space between the forms and the bore 10 and settling by gravity to the bottom of the bore is indicated by a sloping broken line at 18. The broken line 18', indicates the completion of the casting operation on the previous day. The concrete here is solidified or set. The point of greatest buoyancy of the forms occurs substantially at the sloping line 18 of concrete and counterweight cars 19, of which three are shown, are thus placed or moved to this location for maximum counterbalancing effect. The slick line 16 is advanced, that is pulled to the left as viewed in FIG. 1, by movement of the riser car 17 as the concrete is expelled from the slick line 16. The counterweight cars are coupled together and connected by a cable **19*a* to the riser car 17** so that they are advanced automatically in synchronism with the concrete being pumped and deposited at the point or area of greatest buoyancy as the casting operation continues. Thus the counterbalancing effect of the counterweight cars is maintained a maximum automatically.

Referring to FIGS. 3, 4, 5 and 6, it will be seen that the counterweight cars 19 comprise a hollow steel shell 20 forming a series of compartments 21, for receiving a suitable weight, such as scrap iron or steel punchings. The shell 20 is approximately six feet in length and suitably curved to follow the curvature of the arch forms 11. The shell 20 carries two flanged wheels 23 located in tandem relation for rolling on a single rail track 24. The arch forms 11 are coupled together and the sections of track 24 fixed on adjacent forms register so as to form a continuous uninterrupted track. As clearly seen in FIG. 3, the sections of track 24 are attached to a shoulder formed in the outer shell of the arch forms, as by welding, in a horizontal position near the bottom of the forms 11. The wheels 23 are double flanged to insure their staying on the rails 24. As seen in FIG. 4, the hollow shells on the counterweight cars are provided at each end with rollers 25, mounted near the top thereof, which rest against and roll on a flange of a steel angle 26 that projects radially out of the outer shell of the arch forms. The rollers 25 are carried on suitable axles or rods 27 supported in a clevis 28, attached to the shell of the counterweight car. Though the counterweight cars are substantially balanced on the rail 24, an angle 28*a* extends behind the flange of the angle 26, on which the roller 25 rolls, to insure the counterweight cars being held in an upright position.

Figure 9:
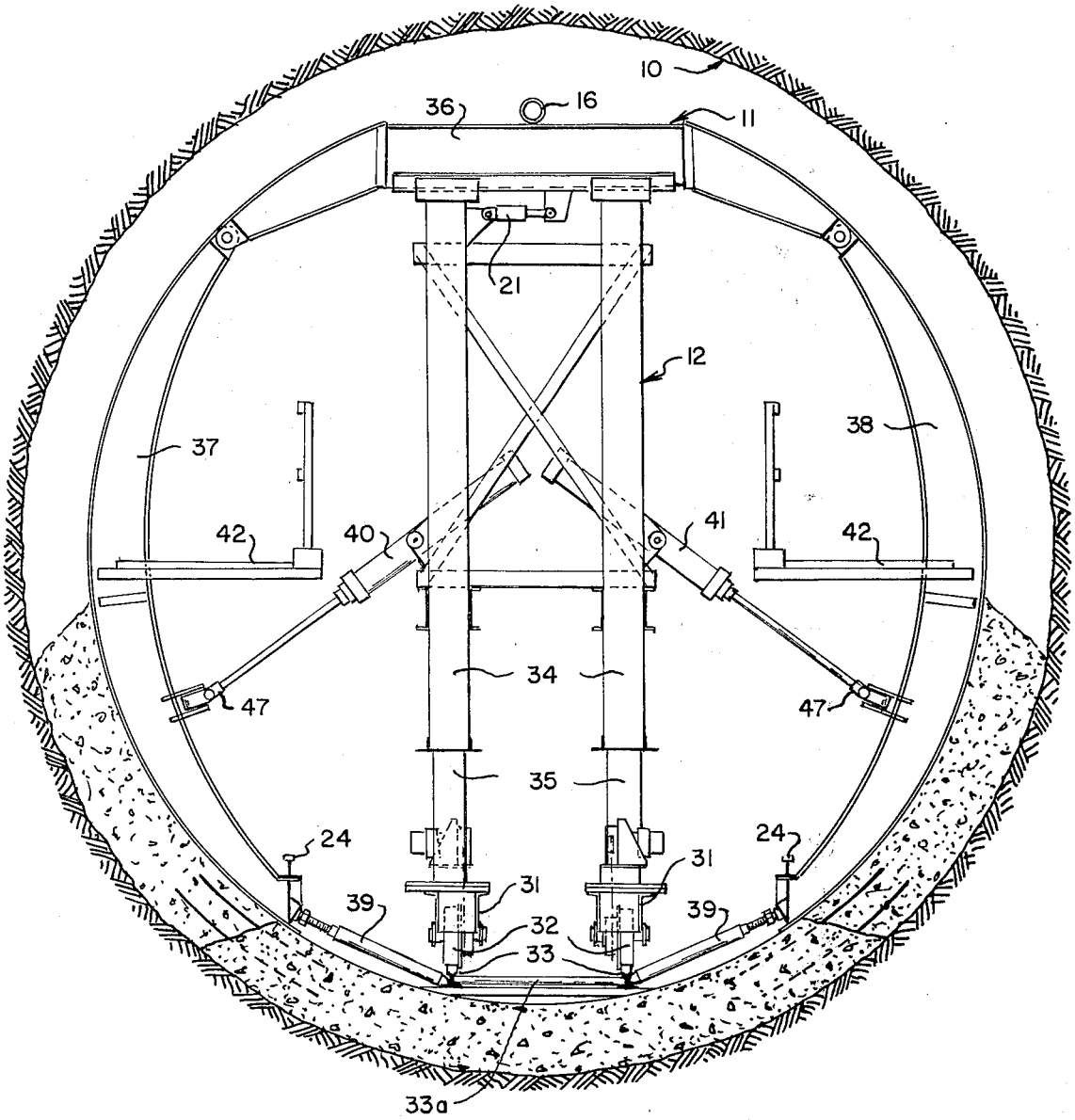
FIG. 9 is a cross-sectional view, taken substantially at the line IX—IX in FIG. 1 through the slope of concrete poured, showing the traveler car and the manner of installing the arch forms.
Figure 10:
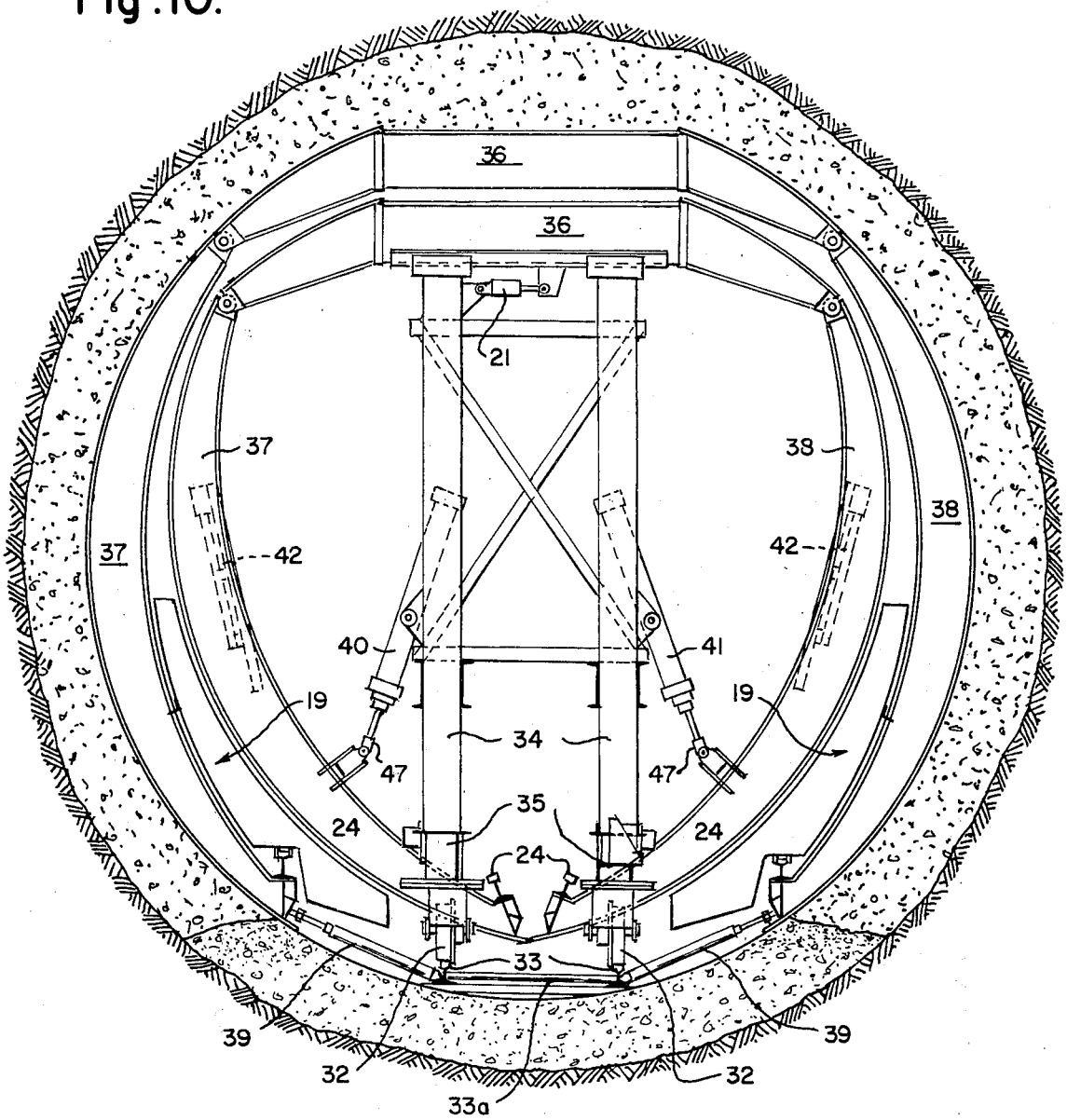
FIG. 10 is a cross-sectional view of the tunnel bore taken substantially on the line X—X of FIG. 1, showing the manner of collapsing the tunnel arch forms and transporting them past the counterweight cars.

Referring to FIGS. 9 and 10, the arrangement and manner of installation and removal of three arch forms 36, 37 and 38 may be briefly described. The side arch forms 37 and 38 are pivoted at their upper ends to opposite ends of the upper most arch form 36. The arch forms are of substantial weight and they are brought into the tunnel bore and installed by means of a traveler car 12. Traveler car 12 comprises a box-like frame supported at opposite ends on a pair of wheel trucks 31. The wheel trucks have four flanged wheels 32 which roll on track rails 33 suitably anchored in a bed of concrete at the bottom of the tunnel bore. A series of rigid rods 33*a* between the webs of the rails 33 serves to support the parallel spacing of the rails. The upright members of the box-like frame comprise two telescoping rectangular members 34 and 35 with a hydraulic vertical ram (not shown) inside the upper member 34 which raises and lowers the uppermost one 36 of the three arch forms. With the aid of hydraulic cylinders 40 and 41 that are pivotally attached to the frame of the traveler car, the side arch forms 37 and 38 are swung outwardly to positions spaced from the tunnel bore and providing the desired thickness of the tunnel wall. A cylinder 21 assists in shifting the upper arch form 36 laterally to properly position the upper ends of the side arch forms 37 and 38. Suitable hydraulic cylinders 39 are interposed between the sides of the track rails 33 and the lower ends of the arch forms 37 and 38 to press the arch forms upwardly and lock them in place.

It will be seen that the slick line 16 extends inwardly through the space between the tunnel bore and the upper most arch form 36 to the point where it is desired to fill in the concrete. It will be seen that concrete emitted from the slick line feeds by gravity into the space between the outer shell of the arch forms and the tunnel bore 10. With the side arch forms 37 and 38 standing in place, cat walks 42 may be installed thereon, as shown, to enable inspection of the forms and whether the space between the arch forms and the tunnel bore has been properly filled with concrete. Suitable inspection holes or doors (not shown) are provided in the side arch forms for this purpose.

As the concrete fills in the space between the arch forms and the tunnel bore 10, the riser car 17 is withdrawn to the left, as viewed in FIG. 1, so that the end of the slick line follows. At the same time, the counterweight cars 19 are shifted correspondingly, by movement of the riser car 17, so as to maintain a maximum effective downward force on the arch forms opposing the force of buoyancy thereon.

At the conclusion of the concrete casting operation with the arch forms in place, and after sufficient time elapses to allow the concrete to solidify properly it is necessary to remove the arch forms, one by one, and set them up in a new series in order to continue the concrete casting operation. To illustrate, let it be assumed that the arch forms 11 on the right end of tunnel bore 10 are to be removed and transported back through the tunnel lining forms 11 around which concrete has solidified, to a new position at the left hand end of the tunnel bore. To do this the sections 36, 37 and 38 of the arch forms must be collapsed in order to strip the arch forms from the solidified concrete and enable them to be brought back through the arch forms remaining in position and past the counterweight cars 19.

It will be seen that in order for the piston rods of cylinders 40 and 41 on the traveler car 12 to be attached to the arch forms 37 and 38, and then released as required, a special coupling is necessary which will now be described.

Figure 8:
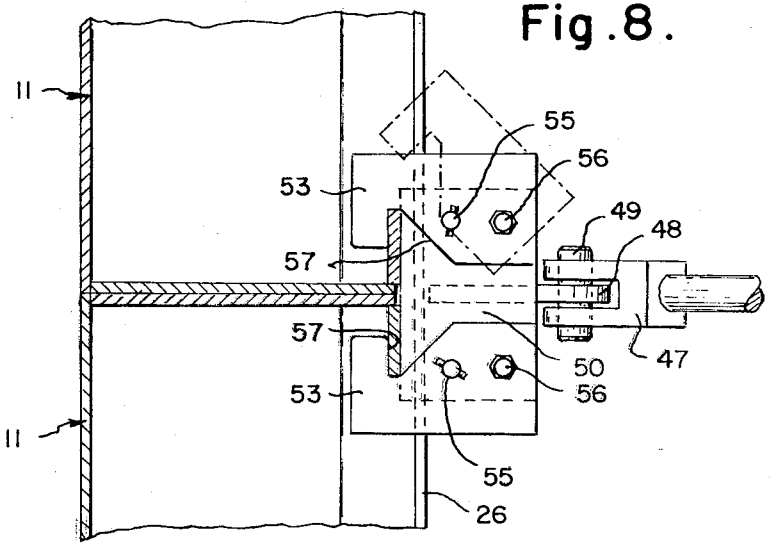
FIG. 8 is a top view of the coupling means shown in FIG. 7.
Figure 7:
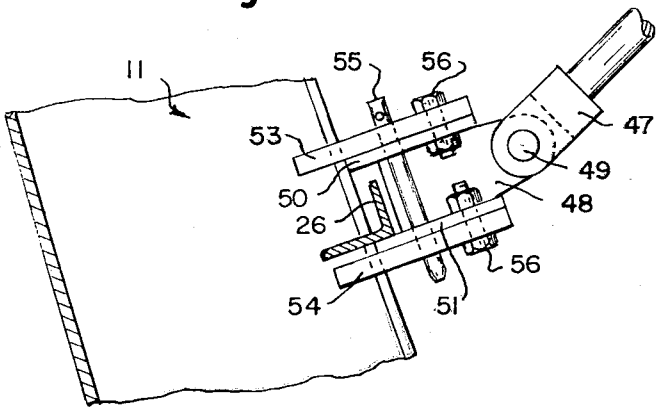
FIG. 7 is a fragmentary enlarged view of the coupling means for attaching the hydraulic cylinders on the traveler car to the arch forms.
Figure 2:
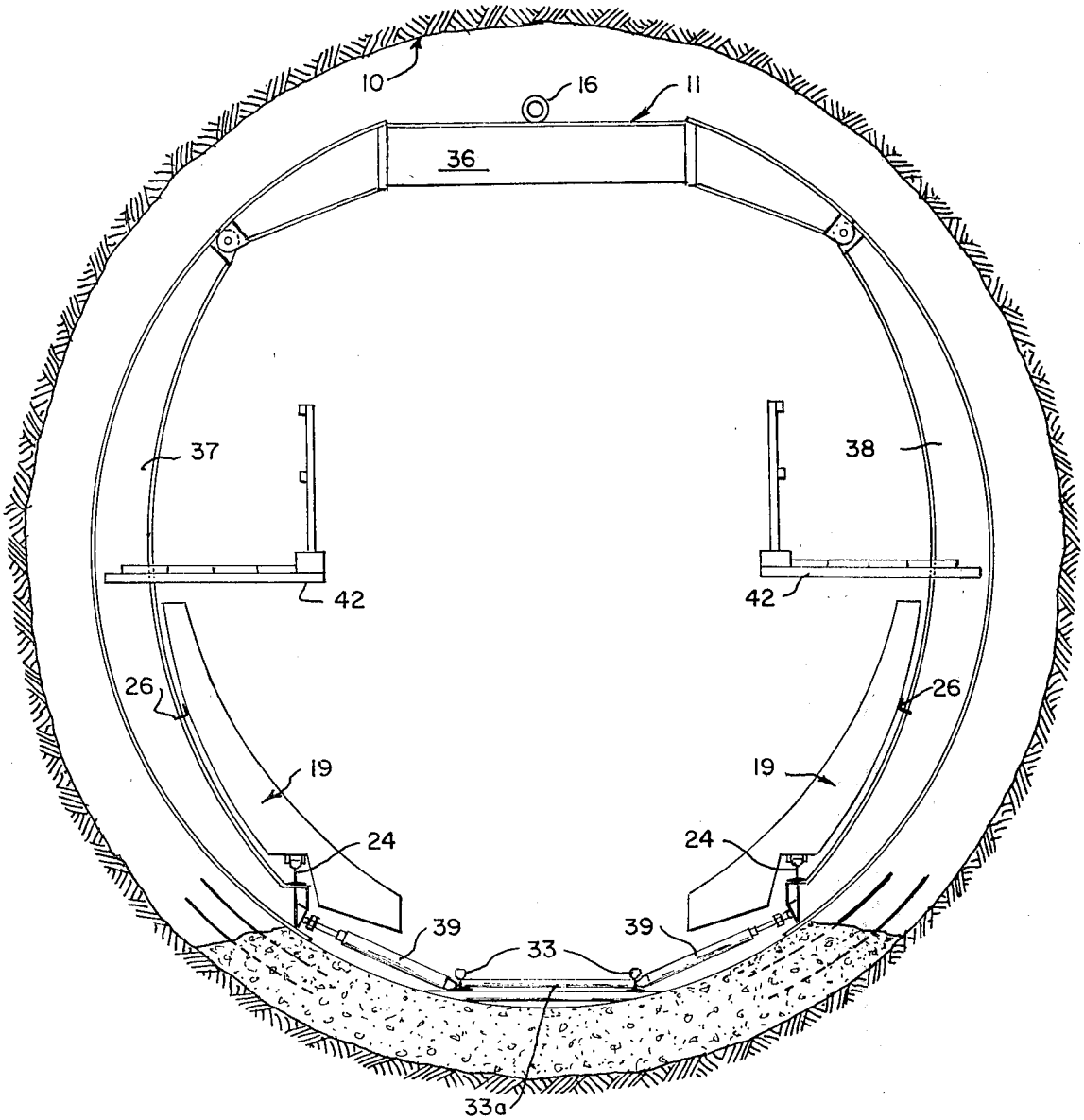
FIG. 2 is a cross-sectional view through the tunnel bore of FIG. 1 at the line II—II, showing the relation of the arch tunnel forms to the rock bore and the manner in which the counterweight cars move on the interior of the tunnel forms.

Referring to FIGS. 7 and 8, it will be seen that the distal end of the piston rods of cylinders 40 and 41 is provided with a clevis 47 in which a member 48 is pivotally retained by a pin 49. The member 48 fits between two parallel plates 50 and 51 to which it is attached as by welding. The plates 50 and 51 each have a pair of cooperating swivelable members 53 and 54, called gripping members loosely hinged thereon by a bolt 56. The gripping members have V-shaped recesses 57 therein which cooperate, when the members are swung towards each other, to grasp the T-shaped joint formed by the abutting shells of two adjoining arch forms. The gripping members 53 and 54 are locked in their gripping position by means of pins 55 which are manually inserted through registering holes in the gripping members and the plates 50 and 51.

It will be seen that with the gripping members in locked position around the T-shaped joint formed by the shells of adjoining arch forms, it is possible for the cylinders 40 and 41 to be operated to pull the arch forms away from the solidified concrete to which the outer shell of the forms adhere. Once released from the solidified concrete in the tunnel bore, the arch forms are then partly collapsed to their position shown in FIG. 10. By lowering the upright members 34 on the traveler car 12, the uppermost arch form 36 is dropped so that the side arch forms 37 and 38 may be further collapsed to the position shown in FIG. 10 by swinging them inwardly with cylinders 40 and 41. In this latter position of the arch forms, the cat walks 42 are folded back into the arch forms 37 and 38. The traveler car 12 may now carry the arch forms telescopically back through existing arch forms and past the counterweight cars 19 that remain in position to the new location.

Once the arch forms are in their new location, they are installed, as before described, in side-by-side position. The piston rods of cylinders 40 and 41 are disconnected from the shells of the arch forms, to enable the traveler car 12 to return to the previous location to pick up another arch form. Thus after repeated return trips of the traveler car to retrieve the arch forms and set them up in a new advanced location, another casting operation of concrete may be begun.

It will be seen from FIG. 10 that the curvature of the counterweight cars 19 is such that there is no obstruction or hindrance to the free movement of the forms on the traveler car therepast.

The advantages of our method of providing a negative buoyancy in tunnel forms will be apparent from the above description, as much time can be saved from installing and removing anchoring bolts or studs, as heretofore.

Moreover, by insuring the movement of the counterweight cars in synchronism with the movement of the concrete supplying pump, we obtain the maximum effectiveness of the counterweight cars in negativing buoyancy in the tunnel forms.

While we have described a specific form of construction for the counterweights, variations therein are possible within the terms of the following claims. Moreover, while we have described a specific form of gripping device for releasably attaching the piston rods of hydraulic cylinders to the arch forms, variations may be made therein.

We claim:

1. A form for a poured concrete tunnel lining comprising a series of adjacent arcuate forms arranged in side-by-side relation in a tunnel bore, a track attached to the interior of said forms, a wheeled vehicle movable on said track in load transmitting relation thereto carrying counterweight means in a load-bearing container for opposing the buoyant force of the liquid concrete at a desired region on said forms.

2. Apparatus according to claim 1, wherein said track is a single rail having segments on each of said arcuate forms and said container is a hollow shell curved in conformity with said arcuate forms and supported in substantially balanced relation on a plurality of tandem related wheels operating on said single-rail track.

3. Apparatus according to claim 1, wherein said container is curved on one side to conform to the curvature of installed tunnel lining forms and curved on the opposite side to conform substantially to the curvature of lining forms in their collapsed position wherein telescopic movement of the lining forms past said container takes place.

4. Apparatus according to claim 2, wherein friction-reducing rollers are carried by said container to engage the tunnel lining forms and provide supplementary support for the container while said container is moved on said tandem-related wheels.

5. In apparatus for constructing a tunnel wall of poured concrete in a tunnel bore comprising arcuate tunnel lining sections installed in contiguous side-by-side relation so as to constitute an essentially arcuate lining spaced from said tunnel bore, and pumping means for supplying a concrete slurry under pressure to the space between the said arcuate lining and the tunnel bore, the improvement comprising a wheeled vehicle movable longitudinally with respect to said tunnel lining sections in load transmitting relation thereto, said vehicle having a load-carrying container thereon providing a counterweight opposing the buoyancy effect on said lining sections due to the concrete slurry.

6. In apparatus for constructing a tunnel wall of poured concrete in a tunnel bore comprising arcuate tunnel lining sections installed progressively in essentially arcuate form in a tunnel bore, and pumping means for supplying a concrete slurry to the space between the arcuate lining and the tunnel bore, the improvement comprising a wheeled vehicle movable with respect to said tunnel lining sections in load transmitting relation thereto and carrying counterweight means for opposing the buoyancy effect on said lining sections due to the concrete slurry, and means for synchronizing the movement of said counterweight carrying vehicle to the pumping of the concrete slurry by said pumping means, to insure maximum effectiveness of said counterweight means in counteracting the buoyancy effect acting on said lining.

7. In apparatus for constructing a tunnel wall of poured concrete in a tunnel bore comprising arcuate tunnel lining form sections installed in adjacent relation, and a vehicle having a pump thereon for supplying a concrete slurry under pressure through a slick line to the space between the lining form sections and the tunnel bore, said vehicle being moved to withdraw the slick line so as to maintain a continuous supply of concrete slurry to the said space, the improvement comprising a single rail track on each of said lining form sections adapted to register with similar rail tracks on adjacent lining form sections, a wheeled vehicle having a plurality of double-flanged wheels in tandem relation and a container thereon for carrying a variable load in substantially balanced relation to said rail track to oppose the buoyancy effect of the concrete slurry on said tunnel lining form sections.

8. Apparatus according to claim 7, including supplementary anti-friction rollers on said container engaging the inside of said lining form sections to stabilize said wheeled vehicle.

9. In apparatus for constructing a tunnel wall in a tunnel bore comprising arcuate tunnel lining form sections installed in adjacent relation, and a vehicle having a pump thereon for supplying a concrete slurry under pressure through a slick line to the space between the lining form sections and the tunnel bore, said vehicle being moved to withdraw the slick line so as to maintain a continuous supply of concrete slurry to the said space, the improvement comprising a single rail track on each of said lining form sections adapted to register with similar rail tracks on adjacent lining form sections, a wheeled vehicle having a plurality of double-flanged wheels in tandem relation and a container thereon for carrying a variable load in substantially balanced relation to said rail track to oppose the buoyancy effect of the concrete slurry on said tunnel lining form sections, and means for synchronizing the movement of said pump-bearing vehicle and that of said wheeled vehicle.

10. In apparatus for constructing a tunnel wall in a tunnel bore comprising arcuate tunnel lining sections installed in adjacent relation, and a vehicle having a pump thereon for supplying a concrete slurry under pressure through a slick line to the space between the lining sections and the tunnel bore, said vehicle being moved to withdraw the slick line so as to maintain a continuous supply of concrete slurry to the said space, the improvement comprising a single rail track on each of said lining sections adapted to register with similar rail tracks on adjacent lining sections, a wheeled vehicle having a plurality of double-flanged wheels in tandem relation and a container thereon for carrying a variable load in substantially balanced relation to said rail track to oppose the buoyancy effect of the concrete slurry on said tunnel lining sections, and cable means connecting said wheeled vehicle and said pump-bearing vehicle to synchronize the movement of said wheeled vehicle to the supply of concrete by said pump.

11. Apparatus for constructing a tunnel lining in a tunnel bore comprising a plurality of arcuate tunnel lining sections installed in contiguous relation in said tunnel bore, a pump for supplying a concrete slurry under pressure through a slick line to the space between the tunnel lining and the tunnel bore, a vehicle carrying said pump for retracting the said slick line as the casting operation progresses, a single rail track on the interior of said tunnel lining sections, a vehicle operating on said single-rail track and carrying counterweight means for opposing the buoyancy effect of said concrete slurry on said tunnel lining sections, and means for causing the said counterweight-carrying vehicle to move synchronously with respect to the said pump-carrying vehicle to maintain maximum negative-buoyancy effectiveness.

12. A method of pouring a concrete tunnel lining in place around a form in a tunnel comprising supplying concrete slurry to the form progressively along its length and moving a counterweight in load-transmitting relation to the form progressively along the form so as to counterbalance the buoyant force exerted by the concrete slurry on the form.

13. The method of claim 12 in which counterweights are moved progressively along both sides of the form at the bottom edges thereof.

14. The method of claim 12 in which the concrete slurry is supplied to the crown of the form and the counterweight is spaced forwardly from the point of said supply in the direction of progression.

* * * * *

UNITED STATES PATENT AND TRADEMARK OFFICE

CERTIFICATE OF CORRECTION

PATENT NO. : 4,407,609

DATED : October 4, 1983

INVENTOR(S) : Henry P. Cerutti, Robert A. Cannon and George G. Lindbloom

It is certified that error appears in the above-identified patent and that said Letters Patent is hereby corrected as shown below:

Column 2, line 7, "and" should be deleted.

Column 2, line 9, "in" should be --of--.

Column 2, line 31, "rise car" should be --riser car--.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*